US008189849B2

(12) United States Patent
Waddell et al.

(10) Patent No.: US 8,189,849 B2
(45) Date of Patent: May 29, 2012

(54) MOVABLE SPEAKER COVERING

(76) Inventors: Steve Waddell, Apopka, FL (US); Leonard Davi, Longwood, FL (US)

( * ) Notice: Subject to any disclaimer, the term of this patent is extended or adjusted under 35 U.S.C. 154(b) by 400 days.

(21) Appl. No.: 11/685,340

(22) Filed: Mar. 13, 2007

(65) Prior Publication Data

US 2008/0226096 A1 Sep. 18, 2008

(51) Int. Cl.
*H04R 1/02* (2006.01)

(52) U.S. Cl. ..... 381/388; 381/386; 381/387; 381/332; 381/333; 181/198; 181/199

(58) Field of Classification Search ..... 381/300–308, 381/87, 386–390, 61–65, 332–336, 150, 381/337, 345, 353, 385, 189, 124; 181/150, 181/198–199, 175, 284, 287; 312/3–6, 7.1–7.2, 312/21–30
See application file for complete search history.

(56) References Cited

U.S. PATENT DOCUMENTS 3,164,431 A * 1/1965 Black ..... 312/282
3,204,722 A * 9/1965 Hare ..... 181/143
3,456,995 A * 7/1969 Nyquist ..... 312/322
3,815,706 A 6/1974 Nagai
3,926,487 A * 12/1975 Reyes ..... 312/234
4,270,023 A * 5/1981 Beveridge ..... 381/388
4,279,454 A * 7/1981 Koiso et al. ..... 312/297
4,953,223 A * 8/1990 Householder ..... 381/387
5,255,970 A * 10/1993 Theosabrata ..... 312/297
5,321,760 A * 6/1994 Gray ..... 381/86
7,080,816 B1 7/2006 Vaccaro
2002/0084727 A1* 7/2002 Miller ..... 312/205
2006/0076860 A1* 4/2006 Hoss ..... 312/312

OTHER PUBLICATIONS

International Search Report dated Jul. 28, 2008 in corresponding International Appln. No. PCT/US08/56833.

* cited by examiner

*Primary Examiner* — Vivian Chin
*Assistant Examiner* — Fatimat O Olaniran
(74) *Attorney, Agent, or Firm* — F. Chau & Associates, LLC

(57) ABSTRACT

A speaker cabinet includes at least one speaker contained in the speaker cabinet, and a speaker covering shrouding the at least one speaker, wherein the speaker covering is movable to expose the at least one speaker. The speaker covering motion may be automatic and provided by an electromechanical motion control system including at least one electric actuator and at least one electric actuator drive circuit. The automatic speaker covering motion may be activated by the electromechanical motion control system in response to an audio signal received by the speaker cabinet.

22 Claims, 9 Drawing Sheets

MOVABLE SPEAKER COVERING

BACKGROUND OF THE INVENTION

1. Technical Field

The present invention relates to an audio speaker cabinet and, more particularly, to an audio speaker cabinet with a movable speaker covering.

2. Discussion of the Related Art

An audio system has audio speaker cabinets housing audio speakers to produce sounds to emanate into the realm of the listener. However, the speakers may be exposed to damage or may be covered with an acoustically transparent material that may be considered unsightly by some, especially when the speaker cabinets are prominently displayed in a home, office or commercial environment. There is a limited choice of acoustically transparent materials for decorative purposes. FIG. 1 shows a conventional speaker cabinet having exposed speakers. FIG. 2 shows a conventional speaker cabinet having speakers covered with an acoustically transparent material. As can be seen from FIGS. 1 and 2, the speaker cabinets may be unprotected or considered unsightly by some.

A decorator may wish to disguise speaker cabinets from view to create an attractive and appealing decor. Decorative speaker coverings may overcome challenges and objections to conventional speaker cabinets and may be considered decor items themselves. A decorative speaker covering may better blend in with home, office, or commercial decor by providing a decorative facade. Also, it is sometimes beneficial to protect the speakers from damage when not in use. Thus, having a speaker covering is desirable to enhance the appearance of the speaker cabinet or to reduce the risk of damage to the speakers. However, a speaker covering must be removed each time a speaker is used. A speaker covering may be cumbersome and difficult to remove, possibly causing damage to the speaker or objects around the speaker.

Accordingly, there is a need for a speaker covering that can be easily removed for maximum sound reproduction, each time the speaker is used.

SUMMARY OF THE INVENTION

An exemplary embodiment of the present invention is a speaker cabinet including at least one speaker contained in the speaker cabinet, and a speaker covering shrouding the at least one speaker, wherein the speaker covering is movable to expose the at least one speaker. The speaker covering motion may be automatic and provided by an electromechanical motion control system including at least one electric actuator and at least one electric actuator drive circuit. The at least one electric actuator may include an electric motor or an electric solenoid. The at least one electric actuator may provide motion to the speaker covering with at least one of gears, belts, linkages, or magnetic induction. The automatic speaker covering motion may be activated by the electromechanical motion control system in response to an audio signal received by the speaker cabinet. The speaker cabinet and the speaker covering may be substantially cylindrical. The speaker covering may rotate around the speaker cabinet to expose the at least one speaker. The speaker covering may slide up or down to expose the at least one speaker. The speaker covering may slide up or down to expose the at least one speaker through a speaker covering aperture. The speaker covering may have a left portion that can slide toward a left side of the speaker cabinet to expose a left side of the at least one speaker, and a right portion that can slide toward a right side of the speaker cabinet to expose a right side of the at least one speaker. The speaker cabinet may have a substantially rectangular cross section and the speaker covering may be substantially rectangular or substantially flat. The speaker covering may slide up or down to expose the at least one speaker. The speaker covering may slide up or down to expose the at least one speaker through a speaker covering aperture. The speaker covering may slide or swing to one side of the speaker cabinet to expose the at least one speaker. The speaker covering may swing to one side of the speaker cabinet to expose the at least one speaker and may slide along the one side of the speaker cabinet after it swings toward the one side of the speaker cabinet. The speaker covering may have a left portion that can slide or swing toward a left side of the speaker cabinet to expose a left side of the at least one speaker, and a right portion that can slide or swing toward a right side of the speaker cabinet to expose a right side of the at least one speaker. The speaker covering may have a left portion that can swing toward a left side of the speaker cabinet to expose a left side of the at least one speaker and can slide along the left side of the speaker cabinet after it swings toward the left side of the speaker cabinet and a right portion that can swing toward a right side of the speaker cabinet to expose a right side of the at least one speaker and can slide along the right side of the speaker cabinet after it swings toward the right side of the speaker cabinet.

An exemplary embodiment of the present invention is a speaker cabinet including at least one speaker contained in the speaker cabinet, and a stationary speaker cabinet base supporting the speaker cabinet, wherein the speaker cabinet rotates on the speaker cabinet base. The speaker cabinet rotary motion may be automatic and provided by an electromechanical motion control system including at least one electric actuator and at least one electric actuator drive circuit. The at least one electric actuator may include an electric motor or an electric solenoid. The at least one electric actuator may provide the rotary motion between the speaker cabinet and the stationary speaker cabinet base with at least one of gears, belts, linkages, or magnetic induction. The automatic rotary motion may be activated by the electromechanical motion control system in response to an audio signal received by the speaker cabinet. The speaker cabinet may include a rotatable speaker cabinet base positioned between the stationary speaker cabinet base and the speaker cabinet, wherein the speaker cabinet rotates with the rotatable speaker cabinet base.

BRIEF DESCRIPTION OF THE DRAWINGS

Exemplary embodiments of the present invention can be understood in more detail from the following descriptions taken in conjunction with the attached drawings in which.

DETAILED DESCRIPTION OF EXEMPLARY EMBODIMENTS

Figure 1:
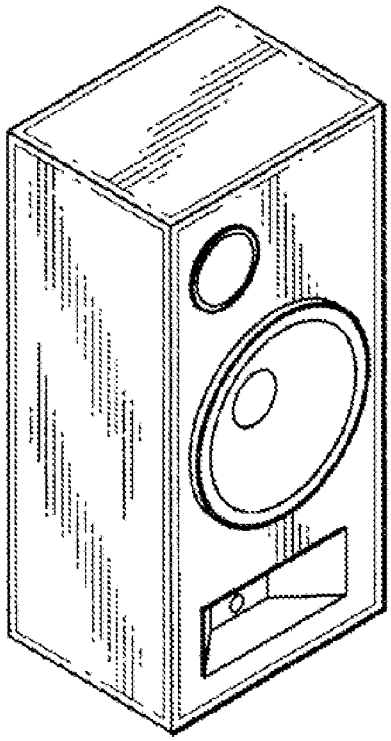
FIG. 1 shows a conventional speaker cabinet having exposed speakers.
Figure 2:
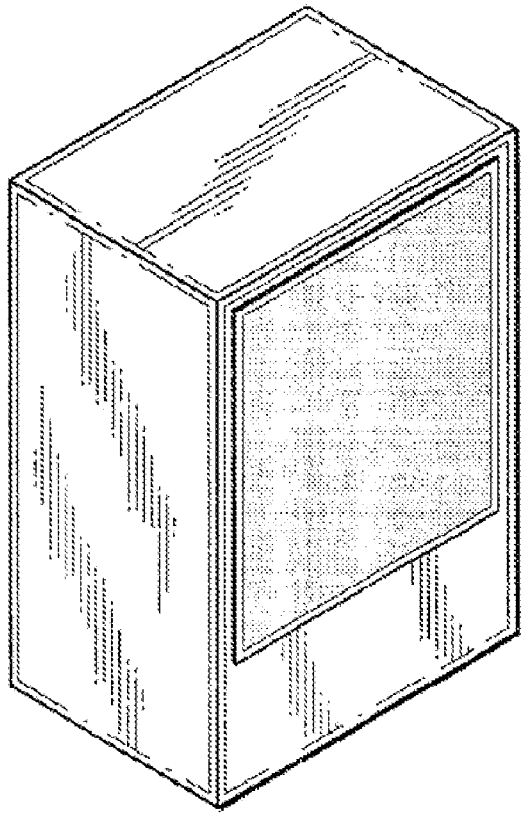
FIG. 2 shows a conventional speaker cabinet having speakers covered with an acoustically transparent material.
Figure 3A:
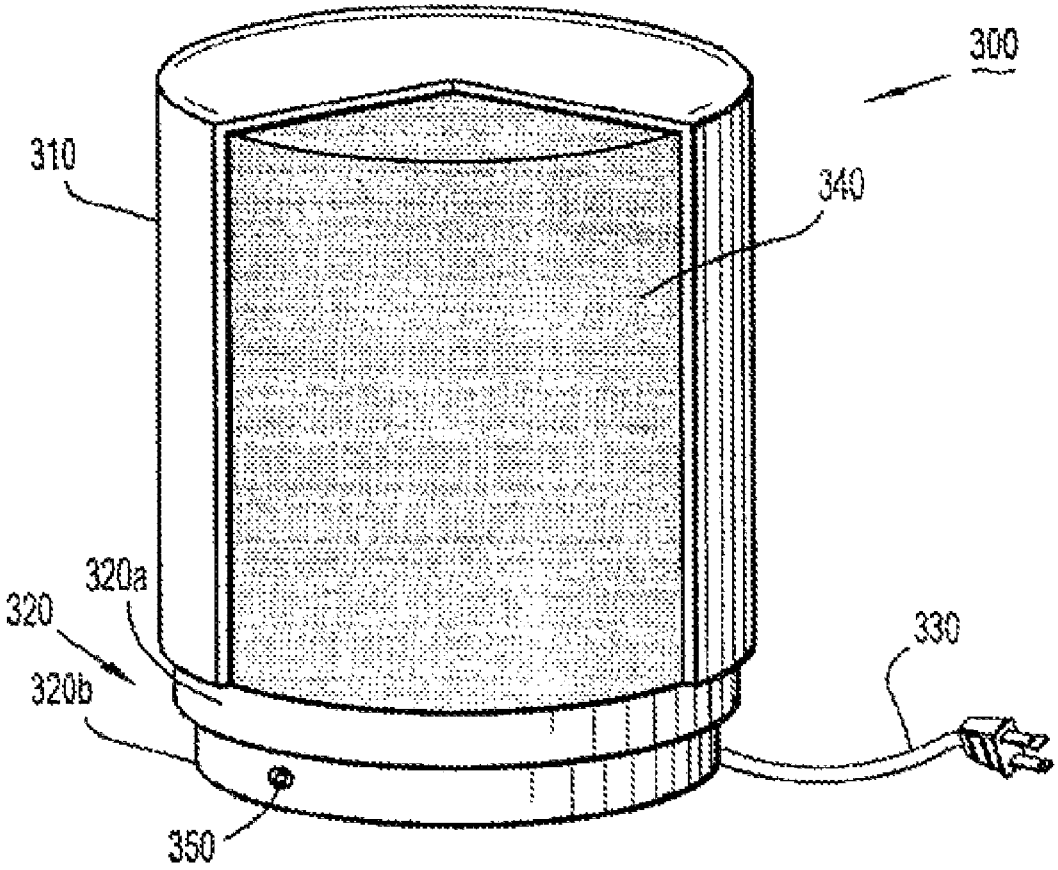
FIG. 3*a* shows a cylindrical speaker cabinet with a rotating speaker covering according to an exemplary embodiment of the present invention.

FIG. 3*a* shows a cylindrical speaker cabinet with a rotating speaker covering according to an exemplary embodiment of the present invention. Referring to FIG. 3*a*, a speaker cabinet 300 having a substantially cylindrical shape includes a speaker covering 310 having a substantially cylindrical shape supported by an upper portion 320*a* of a speaker cabinet base 320, which in turn is supported by a lower portion 320*b* of the speaker cabinet base 320. The upper portion 320*a* of the speaker cabinet base 320 is able to rotate upon the lower portion 320*b* of the speaker cabinet base 320, which remains stationary. The speaker covering 310 rotates with the upper portion 320*a* of the speaker cabinet base 320, upon which it is supported.

The rotation of the upper portion 320*a* of the speaker cabinet base 320 may be provided manually or by an electromechanical motion control located in the upper or lower portions 320*a* or 320*b* of the speaker cabinet base 320. The electromechanical motion control includes at least one electric actuator, such as an electric motor or solenoid, and at least one electric actuator drive circuit. Electrical power to the electromechanical motion control may be provided by internal batteries or by a power supply (not shown) receiving alternating current (AC) from an AC power cord 330 protruding from the stationary lower portion 320*b* of the speaker cabinet base 320.

The electromechanical motion control may provide the rotational motion to the speaker covering 310 and the upper portion 320*a* of the speaker cabinet base 320 from the electric actuator(s) using mechanical or inductive connection elements (not shown), such as gears, belts with pulleys, magnets, a mechanical linkage, or a combination of mechanical or inductive connection elements.

The speaker covering 310 may be constructed of, for example, wood, plastic, or a composite material and may be covered with a decorative material, such as a laminate or wood veneer. The speaker covering 310 has an open segment that may be left open or covered with an acoustically transparent material 340, e.g., cloth. The speaker covering 310 shrouds at least one audio speaker (not shown) that may rotate with and be attached to the speaker covering 310 or the upper portion 320*a* of the speaker cabinet base 320, or may remain stationary while attached to the lower portion 320*b* of the speaker cabinet base 320 while the speaker covering 310 moves to unshroud at least the sound producing portion of the at least one audio speaker.

The speaker covering 310 may have an aperture (not shown), instead of the open segment, which may be covered with an acoustically transparent material 340, e.g., cloth, performing the same function as the open segment in exposing the at least one audio speaker. The speaker covering 310 and related components may form part of an original design of a speaker cabinet or may be added to a modified conventional speaker cabinet.

The at least one audio speaker may be provided with an audio signal via a speaker cable connection 350 located in the stationary lower portion 320*b* of the speaker cabinet base 320, or wirelessly from a wireless audio receiver (not shown), which may be located in the upper or lower portion 320*a* or 320*b* of the speaker cabinet base 320.

The at least one audio speaker is intended to reproduce sounds from an audio system, such as a stereo system. For example, white in use, the at least one audio speaker will face the open segment of the speaker covering 310. Where the at least one audio speaker is stationary, the speaker cabinet 300 may be positioned so the at least one audio speaker is oriented toward an intended listener. The speaker covering 310 is rotated to orient the open segment toward the intended listener thereby exposing the at least one audio speaker to provide unobstructed sound reproduction when the at least one audio speaker is in use, and is rotated to orient the open cylindrical segment away from view to provide a pleasing decor when the at least one audio speaker is not in use. For example the speaker covering 310 may include a decorative design, such as a wooden relief pattern, located on the side opposite the open segment.

Where the at least one audio speaker rotates, the speaker cabinet 300 is positioned so the open segment of the speaker covering 310 is oriented toward the intended listener thereby directing the at least one audio speaker to provide unobstructed sound reproduction when the at least one audio speaker is in use, and is oriented away from view to provide a pleasing decor when the at least one audio speaker is not in use.

Figure 3B:
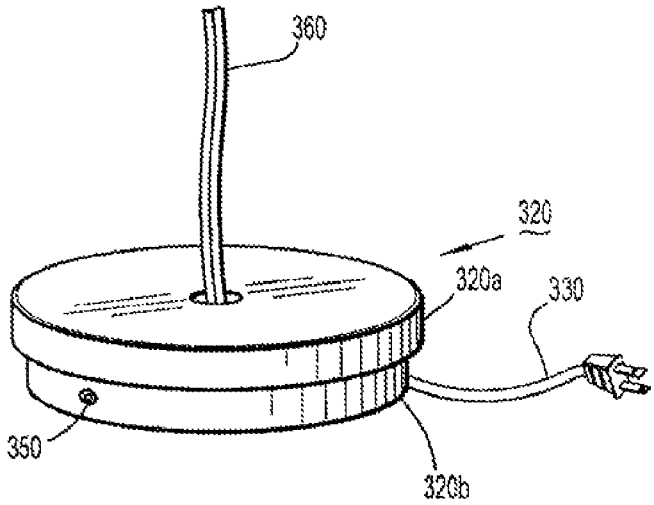
FIG. 3*b* shows a speaker cabinet base of FIG. 5*a;*
Figure 3C:
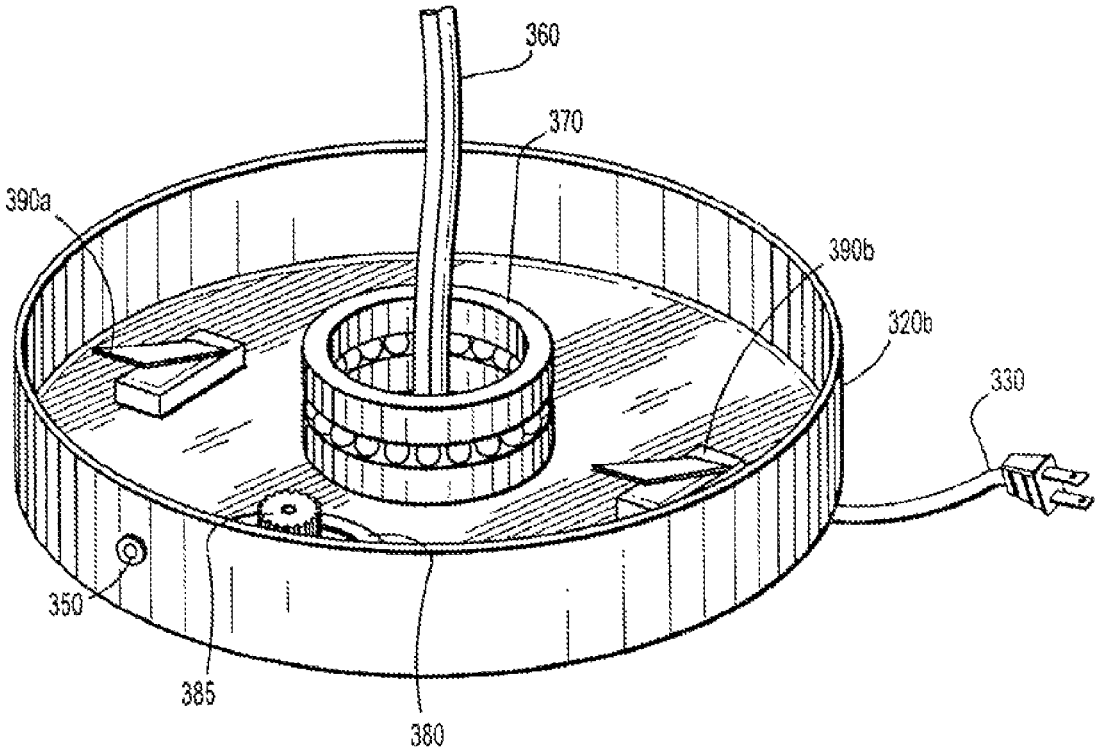
FIG. 3*c* shows a lower portion of the speaker cabinet base of FIG. 3*b;*

FIG. 3*b* shows a speaker cabinet base according to an exemplary embodiment of the present invention. FIG. 5*c* shows a lower portion of the speaker cabinet base of FIG. 3*b*. Referring to FIGS. 3*b* and 3*c* an exemplary embodiment of the lower portion 320*b* of the speaker cabinet base 320 includes electrical and mechanical components facilitating rotation between the upper and lower portions 320*a* and 320*b* of the speaker cabinet base 320.

A bearing and support system, such as at least one ball bearing 370 or plastic or metal bushing (not shown), provides support for the upper portion 320*a* of the speaker cabinet base 320 and components supported thereon, while allowing smooth, low resistance rotation. The speaker wiring 360 may be routed to the at least one audio speaker through the center of the ball bearing 370 or plastic or metal bushings.

An electric actuator, for example, an electric motor 380 with a drive gear 385 or pulley (not shown), may be located in the lower portion 320*b* of the speaker cabinet base 320, which provides rotational motion to the upper portion 320*a* of the speaker cabinet base 320 via an internal tooth gear (not shown) or belt and pulley (not shown) attached to the upper portion 320*a* of the speaker cabinet base. Position limit sensors 390*a* and 390*b*, such as micro or touch switches, position encoders (not shown), or photocells (not shown), are mounted in the lower portion 320*b* of the speaker cabinet base 320, which provide feedback for an indication of the rotational position of the upper portion 320*a* of the speaker cabinet base 320 to the electromechanical motion control. Additionally, the electromechanical motion control may benefit in performance from velocity feedback obtained from position encoders or tachometers (not shown). The electromechanical motion control may be achieved using an electronic motion control system provided by discrete electronic components or a microprocessor. An exemplary embodiment of an electronic motion control system is described later with respect to FIG. 8 where the electric actuator is an electric motor activated by the presence of an audio signal. Other electronic motion control systems, which are known in the art, may be used.

When the at least one audio speaker contained in the speaker cabinet 300 is to be used or is not to be used, the speaker covering 310 may be rotated manually, or by the electromechanical motion control system being activated by a switch commanding an appropriate orientation, by a remote control command, by an automatic operation commanded by a signal from an audio system, or by the presence of an audio signal provided to the at least one speaker.

Figure 3D:
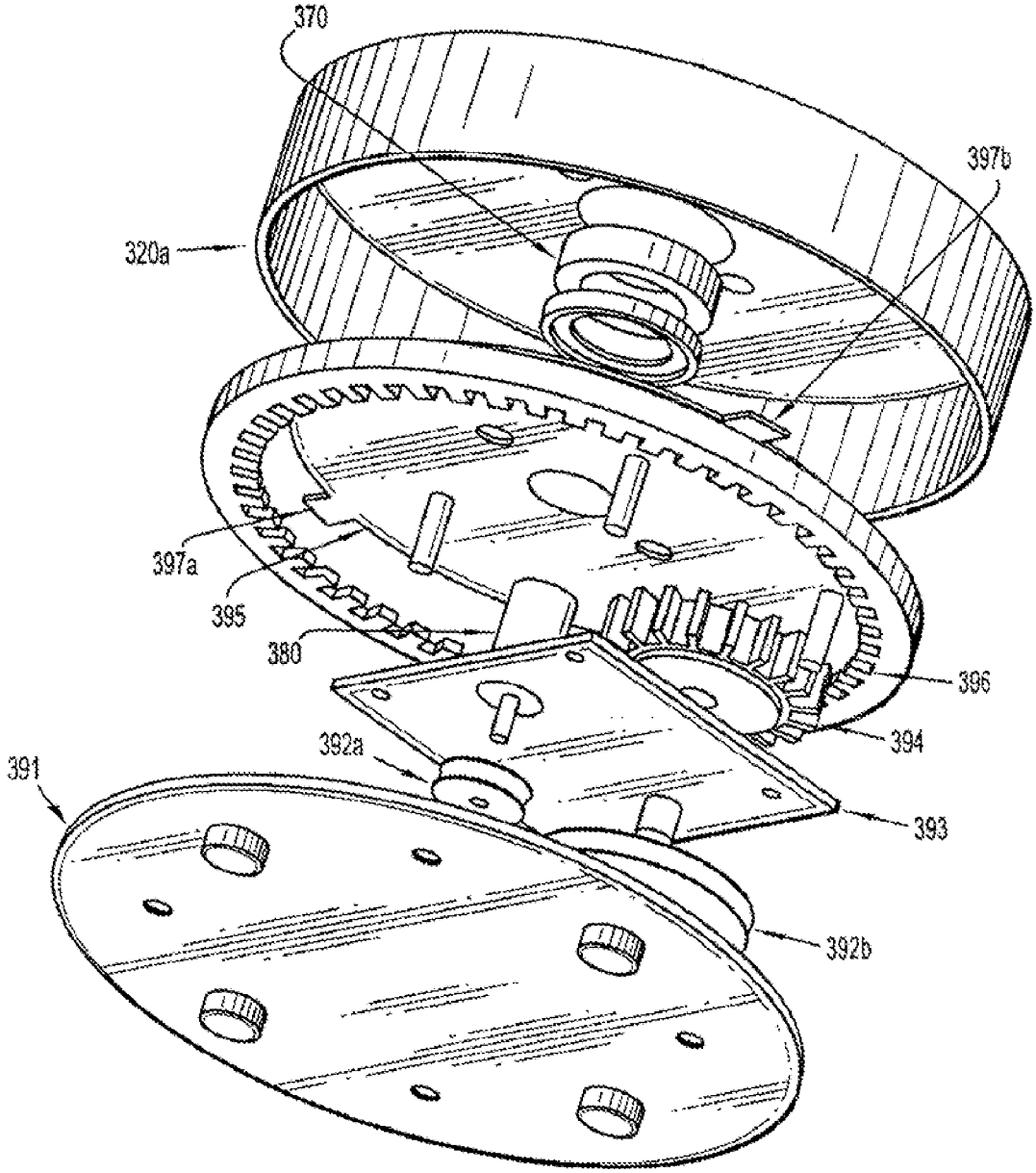
FIG. 3*d* shows a drive portion of a speaker cabinet base of FIG. 3*a;*

FIG. 3*d* shows a drive portion of a speaker cabinet base of FIG. 3*a*. An exemplary embodiment of the speaker cabinet base 320 provides motion to the upper portion 320*a* of the speaker cabinet base from an electromechanical motion control located in the lower portion 320*b* of the speaker cabinet base 320. The lower portion 320*b* of the speaker cabinet base 320 includes a lower plate 391, a central plate 393 spaced above the lower plate 391 and an upper plate 395 spaced above the central plate 393. An electric motor 380 is mounted above the central plate 393 with its shaft protruding below the central plate 393. A small pulley 392*a* is mounted to and driven by the electric motor 380 below the central plate 393 which drives a belt (not shown) driving a large pulley 392*b*. The large pulley 392*b* is mounted in bearings and connected to an external tooth gear 394 mounted above the central plate 393. The external tooth gear 394 is in contact with an internal tooth gear 396 attached to a lower inner edge of the upper portion 320*a* of the speaker cabinet base 320. The upper portion 320*a* of the speaker cabinet base 320 is supported by bearings 370 which are supported by the upper plate 395. The upper plate 395 has position flags 397*a* and 397*b* protruding from its edge to contact the position limit sensors 390*a* and 390*b*, providing position information to limit the rotational travel of the upper portion 320*a* of the speaker cabinet base 320 and the speaker covering 310.

Figure 3E:
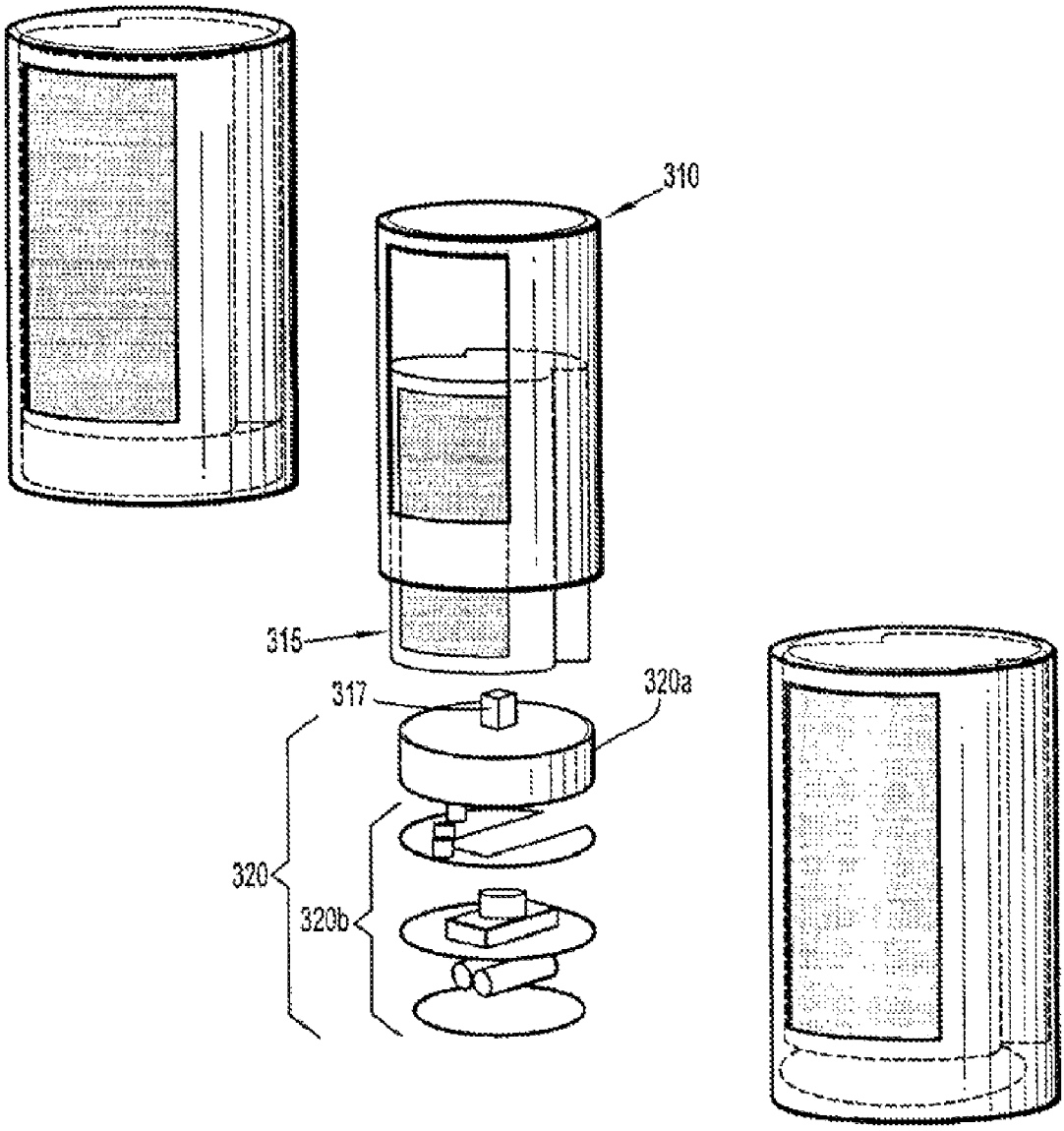
FIG. 3*e* shows a cylindrical speaker cabinet with a rotating speaker covering according to an exemplary embodiment of the present invention.

FIG. 3*e* shows a cylindrical speaker cabinet according to an exemplary embodiment of the present invention. Similar to the speaker cabinet 300 of FIG. 3*a*, the speaker covering 310 has an open segment exposing at least one audio speaker, however, the speaker covering 310 fits over and rotates with a speaker assembly 315, where the speaker covering 310 and the speaker assembly 315 are supported on and rotated by an upper portion 320*a* of a speaker cabinet base 320. The speaker housing assembly 315 contains the at least one audio speaker. The at least one audio speaker may be left uncovered or may be covered with an acoustically transparent material 340, e.g., cloth. The speaker housing assembly 315 is located by and rotated with a key element 317 affixed to and protruding upwardly from the rotating upper portion 320*a* of the speaker cabinet base 320. The upper portion 320*a* of the speaker cabinet base 320 may have rotation provided by, for example, mechanisms as described for FIG. 3*c* or 3*d*.

Figure 4:
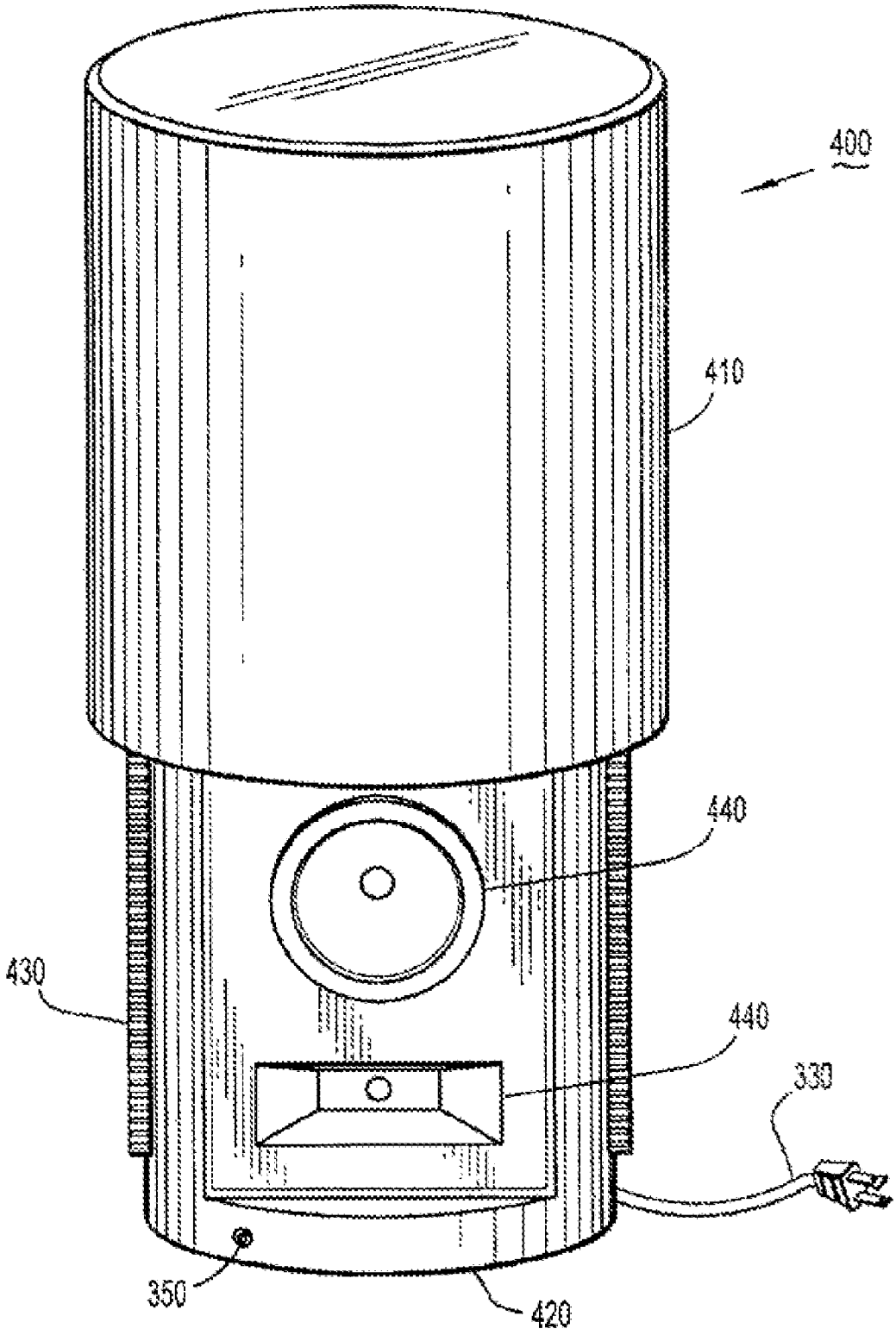
FIG. 4 shows a cylindrical speaker cabinet with a vertically retracting speaker covering according to an exemplary embodiment of the present invention.

FIG. 4 shows a cylindrical speaker cabinet with a vertically retracting speaker covering according to an exemplary embodiment of the present invention. Referring to FIG. 4, the speaker cabinet 400 having a substantially cylindrical shape includes a speaker covering 410 having a substantially cylindrical shape supported by a speaker cabinet base 420. The speaker covering 410 is attached to and supported by the speaker cabinet base 420 with a mechanical connection 430, such as a track system or a mechanical linkage. The speaker covering 410 is able to slide vertically to expose at least one audio speaker 440 mounted to the speaker cabinet base 420 or conceal the at least one audio speaker 440.

The vertical motion of the speaker covering 410 may be provided manually or by an electromechanical motion control (not shown) located in the speaker cabinet base 420. Electrical power to the electromechanical motion control may be provided by internal batteries or by a power supply receiving alternating current (AC) from an AC power cord 330 protruding from the speaker cabinet base 420.

The speaker covering 410 may be constructed of, for example, wood, plastic or a composite material and may be covered with a decorative material, such as a laminate or wood veneer. The at least one audio speaker 440 is intended to reproduce sounds from an audio system, such as a stereo system. While in use, the at least one audio speaker 440 will be exposed by the speaker covering 410 sliding vertically uncovering the at least one audio speaker 440 thereby allowing the at least one audio speaker 440 to provide unobstructed sound reproduction. While not in use, the at least one audio speaker 440 will be concealed from view by the speaker covering 410 sliding vertically over the at least one audio speaker 440 to provide a pleasing decor.

The at least one audio speaker 440 may be provided with an audio signal via a speaker cable connection 350 located in the speaker cabinet base 420, or wirelessly from a wireless audio receiver located in the speaker cabinet base 420.

The electromechanical motion control includes at least one electric actuator (not shown), for example, an electric motor or an electric solenoid, and at least one electric actuator drive circuit (not shown). The electromechanical motion control may provide the sliding motion to the speaker covering 410 from the electric actuator(s) using mechanical or inductive connection elements (not shown), such as gears, magnets, a mechanical linkage, or a combination of mechanical or inductive connection elements.

The electromechanical motion control may receive position feedback to indicate the appropriate position of the speaker covering 410 from such position sensors as micro or touch switches, position encoders, and photocells. Additionally, the electromechanical motion control may benefit in performance from velocity feedback obtained from position encoders or tachometers. The electromechanical motion control may be achieved using an electronic motion control system provided by discrete electronic components or a microprocessor. Other electronic motion control systems, which are known in the art, may also be used.

When the at least one audio speaker 440 contained in the speaker cabinet 400 is to be used or is not to be used, the speaker covering 410 may be slid manually, or by the electromechanical motion control system being activated by a switch commanding an appropriate orientation, by a remote control command, by an automatic operation commanded by a signal from an audio system, or by the occurrence of an audio signal provided to the at least one speaker 440.

The speaker covering 410 may have an aperture, which may be covered with an acoustically transparent material. The speaker covering 410 vertical motion can position the speaker covering 410 aperture over the at least one audio speaker to provide unobstructed sound reproduction.

Figure 5:
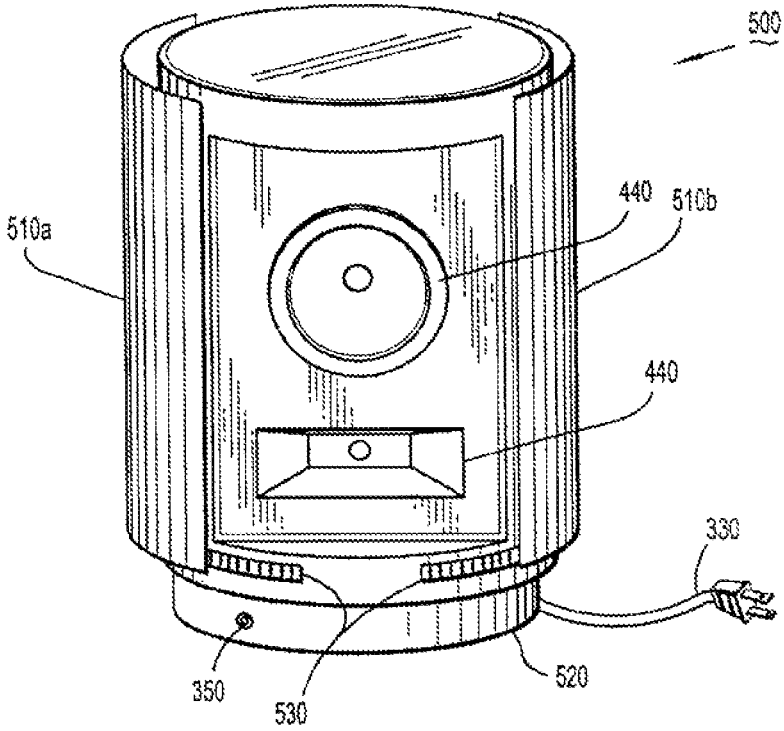
FIG. 5 shows a cylindrical speaker cabinet with a split speaker covering according to an exemplary embodiment of the present invention.

FIG. 5 shows a cylindrical speaker cabinet with a split speaker covering according to an exemplary embodiment of the present invention. Referring to FIG. 5, the speaker cabinet 500 having a substantially cylindrical shape includes a speaker covering 510 having a substantially cylindrical shape supported by a speaker cabinet base 520. The speaker covering 510 includes a left segment 510*a* and a right segment 510*b* disposed approximately equally on either side of at least one audio speaker 440 mounted to the speaker cabinet base 520. When the at least one audio speaker 440 is to be exposed, the left segment 510*a* slides left from a center closed position to the left front of the at least one audio speaker 440, and the right segment 510*a* slides right from a center closed position to the right front of the at least one audio speaker 440. The left and right segments 510*a* and 510*b* are attached and supported by the speaker cabinet base 520 with a mechanical connection 530, such as a track system or a mechanical linkage. The left and right segments 510*a* and 510*b* are able to slide along the sides of the speaker cabinet 510 to expose at least one audio speaker 440 mounted to the speaker cabinet base 520 or conceal the at least one audio speaker 440.

The sliding motion of the left and right segments 510*a* and 510*b* may be provided manually or by an electromechanical motion control (not shown) located in the speaker cabinet base 520. Electrical power to the electromechanical motion control may be provided by internal batteries or by a power supply receiving alternating current (AC) from an AC power cord 330 protruding from the speaker cabinet base 520.

The left and right segments 510*a* and 510*b* may be constructed of, for example, wood, plastic or a composite material and may be covered with a decorative material, such as a laminate or wood veneer. The at least one audio speaker 440 is intended to reproduce sounds from an audio system, such as a stereo system. While in use, the at least one audio speaker 440 will be exposed by the left and right segments 510*a* and 510*b* sliding along their respective sides of the speaker cabinet 500 uncovering the at least one audio speaker 440 thereby allowing the at least one audio speaker 440 to provide unobstructed sound reproduction. While not in use, the at least one audio speaker 440 will be concealed from view by the left and right segments 510*a* and 510*b* sliding over the at least one audio speaker 440 to provide a pleasing decor.

The at least one audio speaker 440 may be provided with an audio signal via a speaker cable connection 350 located in the speaker cabinet base 520, or wirelessly from a wireless audio receiver located in the speaker cabinet base 520.

The electromechanical motion control includes at least one electric actuator (not shown), for example, an electric motor or an electric solenoid, and at least one electric actuator drive circuit (not shown). The electromechanical motion control may provide the sliding motion to the left and right segments 510*e* and 510*b* from the electric actuator(s) using mechanical or inductive connection elements (not shown), such as gears, magnets, a mechanical linkage, or a combination of mechanical or inductive connection elements.

The electromechanical motion control may receive position feedback to indicate the appropriate position of the left and right segments 510*a* and 510*b* from such position sensors as micro or touch switches, position encoders, and photocells. Additionally, the electromechanical motion control may benefit in performance from velocity feedback obtained from position encoders or tachometers. The electromechanical motion control may be achieved using an electronic motion control system provided by discrete electronic components or a microprocessor. Other electronic motion control systems, which are known in the art, may also be used.

When the at least one audio speaker 440 contained in the speaker cabinet 500 is to be used or is not to be used, the left and right segments 510*a* and 510*b* may be said manually, or by the electromechanical motion control system being activated by a switch commanding an appropriate orientation, by a remote control command, by an automatic operation commanded by a signal from an audio system, or by the occurrence of an audio signal provided to the at least one speaker 440.

Alternatively, the speaker covering 510 may be a single segment (not shown) that is able to slide up, down, left or right to expose the at least one audio speaker 440.

Figure 6:
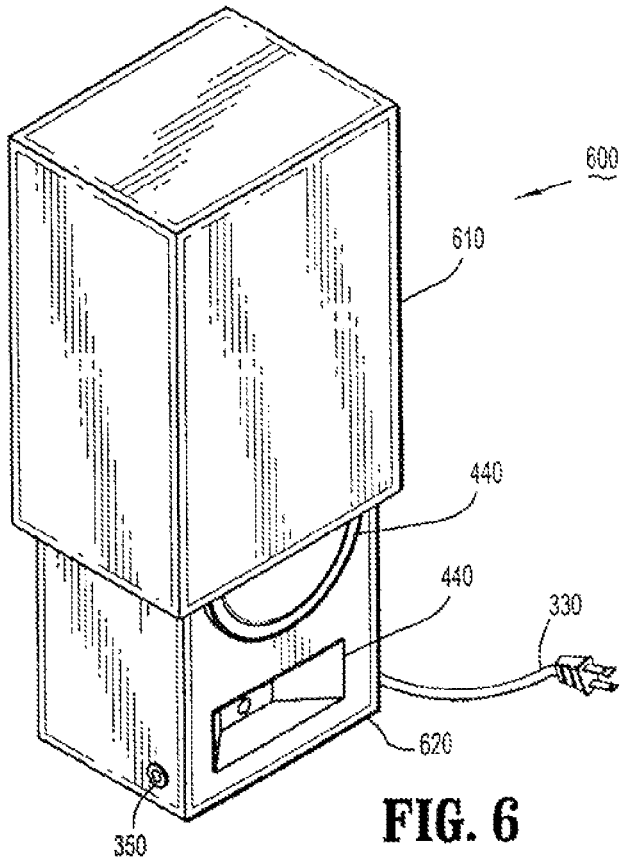
FIG. 6 shows a rectangular speaker cabinet with a vertically retracting speaker covering according to an exemplary embodiment of the present invention.

FIG. 6 shows a rectangular speaker cabinet with a vertically retracting speaker covering according to an exemplary embodiment of the present invention. Referring to FIG. 6, the speaker covering 610 moves vertically, similar to the speaker covering 410 of FIG. 4. The structure and function of the speaker cabinet 600 is similar to the speaker cabinet 400 of FIG. 4 and will not be described further.

Figure 7:
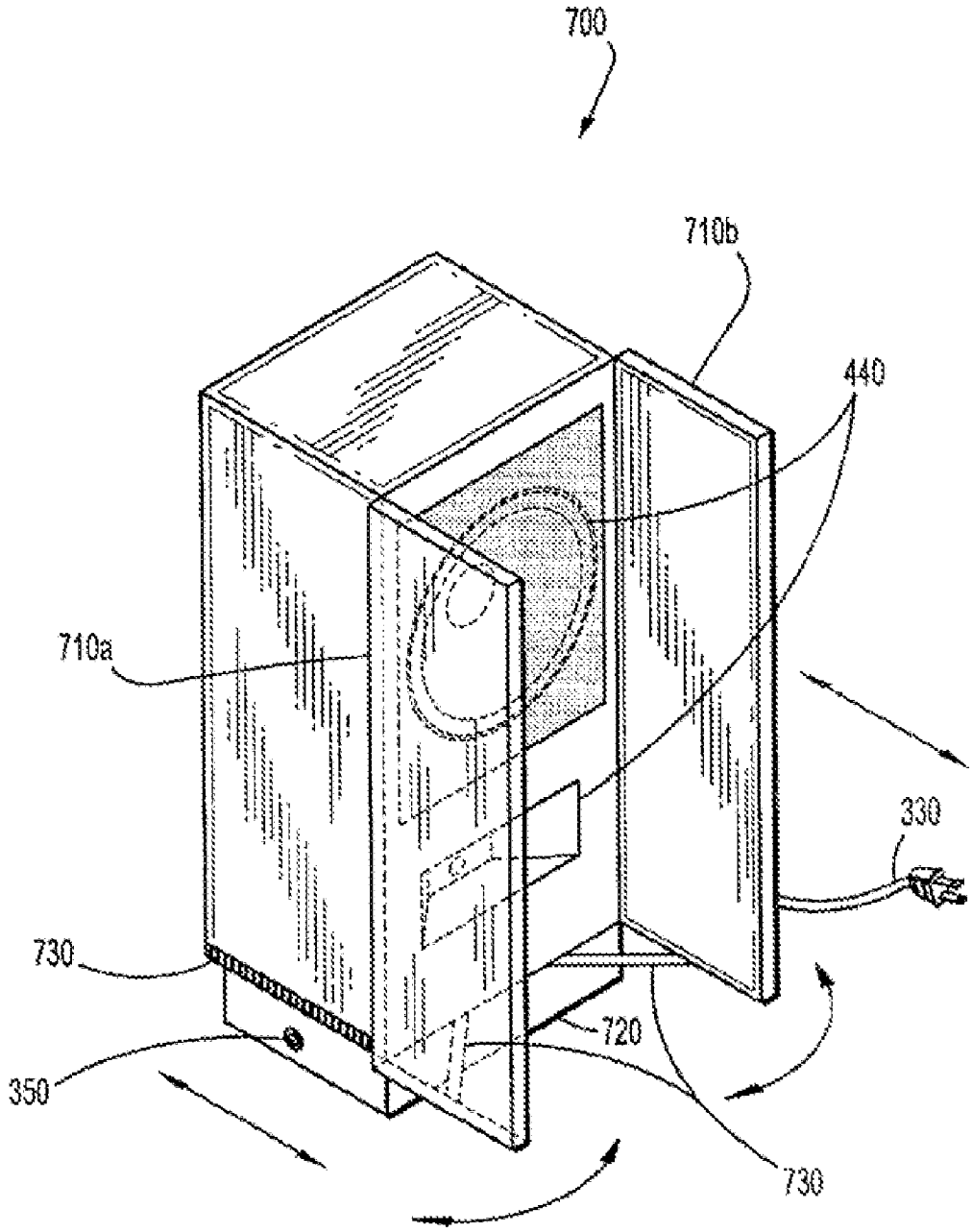
FIG. 7 shows a rectangular speaker cabinet with a split speaker covering according to an exemplary embodiment of the present invention.

FIG. 7 shows a rectangular speaker cabinet with a split speaker cabinet covering according to an exemplary embodiment of the present invention. Referring to FIG. 7, the speaker cabinet 700 having a substantially rectangular shape includes a speaker covering 710 substantially flat supported by a speaker cabinet base 720. The speaker covering 710 includes a left portion 710*a* and a right portion 710*b* disposed approximately equally on either side of at least one audio speaker 440 mounted to the speaker cabinet base 720. When the at least one audio speaker 440 is to be exposed, the left portion 710*a* slides or swings left from a center closed position to the left front of the at least one audio speaker 440, and the right portion 710*a* slides or swings right from a center closed position to the right front of the at least one audio speaker 440. The left and right portions 710*a* and 710*b* are attached and supported by the speaker cabinet base 720 with a mechanical connection 730, such as hinges, a track system, or a mechanical linkage. The left and right portions 710*a* and 710*b* are able to slide along the sides of the speaker cabinet 710 or swing away from in front of the speaker cabinet 710 to expose at least one audio speaker 440 mounted to the speaker cabinet base 720 or conceal the at least one audio speaker 440.

The sliding or swinging motion of the left and right portions 710*a* and 710*b* may be provided manually or by an electromechanical motion control (not shown) located in the speaker cabinet base 720. Electrical power to the electromechanical motion control may be provided by internal batteries or by a power supply receiving alternating current (AC) from an AC power cord 330 protruding from the speaker cabinet base 720.

The left and right portions 710*a* and 710*b* may be constructed of, for example, wood, plastic, or a composite material and may be covered with a decorative material, such as a laminate or wood veneer. The at least one audio speaker 440 is intended to reproduce sounds from an audio system, such as a stereo system. While in use, the at least one audio speaker 440 will be exposed by the left and right portions 710*a* and 710*b* sliding along their respective sides of the speaker cabinet 700 or swinging away from in front of the speaker cabinet 700 uncovering the at least one audio speaker 440 thereby allowing the at least one audio speaker 440 to provide unobstructed sound reproduction. While not in use, the at least one audio speaker 440 will be concealed from view by the left and right portions 710*a* and 710*b* sliding or swinging over the at least one audio speaker 440 to provide a pleasing decor.

The at least one audio speaker 440 may be provided with an audio signal via a speaker cable connection 350 located in the speaker cabinet base 720, or wirelessly from a wireless audio receiver located in the speaker cabinet base 720.

The electromechanical motion control includes at least one electric actuator (not shown), for example, an electric motor or an electric solenoid, and at least one electric actuator drive circuit (not shown). The electromechanical motion control may provide the sliding motion to the left and right portions 710*a* and 710*b* from the electric actuator(s) using mechanical or inductive connection elements (not shown), such as gears, magnets, a mechanical linkage, or a combination of mechanical or inductive connection elements.

The electromechanical motion control may receive position feedback to indicate the appropriate position of the left and right portions 710*a* and 710*b* from such position sensors as micro or touch switches position encoders and photocells. Additionally, the electromechanical motion control may benefit in performance from velocity feedback obtained from position encoders or tachometers. The electromechanical motion control may be achieved using an electronic motion control system provided by discrete electronic components or a microprocessor. Other electronic motion control systems, which are known in the art, may also be used.

When the at least one audio speaker 440 contained in the speaker cabinet 700 is to be used or is not to be used, the left and right portions 710*a* and 710*b* may be slid manually, or by the electromechanical motion control system being activated by a switch commanding an appropriate orientation, by a remote control command, by an automatic operation commanded by a signal from an audio system, or by the occurrence of an audio signal provided to the at least one speaker 440.

Where the left and right portions 710*a* and 710*b* are able to swing from in front of the speaker cabinet 700, they may also be able to slide along their respective sides of the speaker cabinet using a track system to further provide unobstructed sound reproduction from the at least one audio speaker 440.

Figure 8:
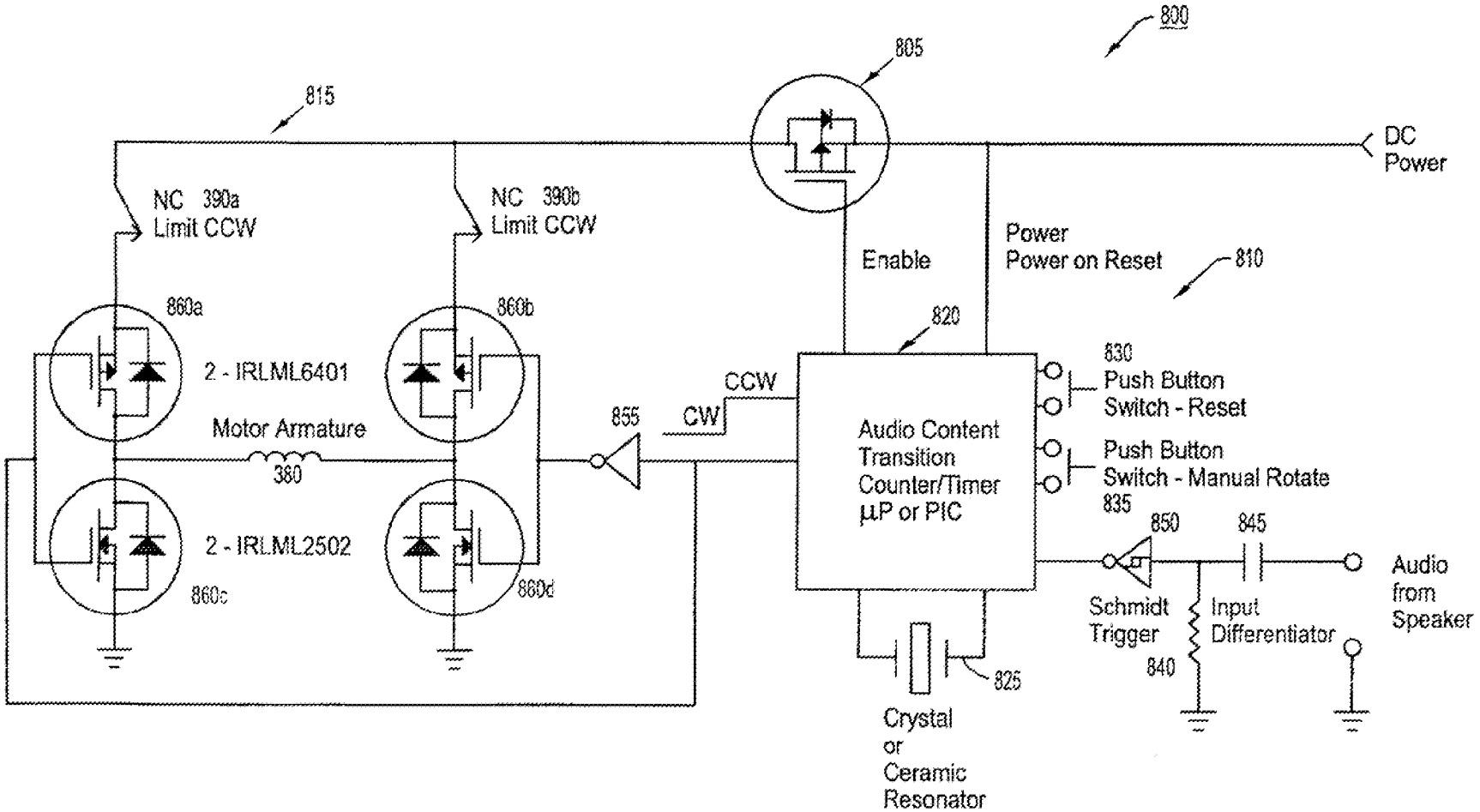
FIG. 8 is a schematic diagram of an electronic motion control circuit for controlling speaker covering motion according to an exemplary embodiment of the present invention.

FIG. 8 is a schematic diagram of an electronic motion control circuit for controlling speaker covering motion according to an exemplary embodiment of the present invention. The electronic motion control circuit 800 as described applies where the electric actuator is a DC electric motor actuated by the presence of an audio signal. The electronic motion control circuit 800 includes a power switch section 805, an audio signal detection section 810, and a motor control section 815.

DC electrical power to the electronic motion control circuit 800 may be provided by internal batteries (not shown) or by a power supply (not shown) receiving current from an AC power cord 330. The power switch section 805 may be implemented with a transistor, such as a power metal oxide semiconductor field effect transistor (MOSFET) device, and ancillary circuitry. The power switch section 805 is used to apply power to the motor control section 815 when an enable signal is received from the audio signal detection section 810. The power switch section 805 is connected between the electrical power and the motor control section 815, and power can pass through the power switch section 805 according to an active state or level of the enable signal from the audio signal detection section 810.

The audio signal detection section 810 includes an Audio Content Transition Counter/Timer 820, supporting devices, such as a crystal or ceramic resonator 825, a reset switch 830, a manual rotate switch 835, and ancillary circuitry. The Audio Content Transition Counter/Timer 820 may be a dedicated semiconductor device or it may be implemented using discrete circuitry, a microprocessor, a programmable logic controller or another equivalent electronic device. The Audio Content Transition Counter/Timer 820 receives an audio signal provided at the speaker wiring 360. The audio signal provided to the Audio Content Transition Counter/Timer 820 is filtered and conditioned with a resistor 840, a capacitor 845, and a Schmidt trigger device 850. The filtered and conditioned audio signal is monitored by the Audio Content Transition Counter/Timer 820, which determines whether the frequency content and the duration of the filtered and conditioned audio signal represents an active audio state, wherein valid audio signals are being received. Initial application of power to the Audio Content Transition Counter/Timer 820 causes a power-on reset to initialize the Audio Content Transition Counter/Timer 820 to a known state. The Audio Content Transition Counter/Timer 820 can also be initialized to a known state by manual operation of the reset switch 830.

In normal operation, the Audio Content Transition Counter/Timer 820 may maintain an awareness of the position of the speaker covering. The Audio Content Transition Counter/Timer 820 controls the electric actuator by outputting the enable signal to the power switch section 805 and a direction signal to the motor control section 815. The direction signal has an appropriate logic level to open the speaker covering when an audio signal is detected, such as a clockwise electric motor direction, and changes to an opposite logic level to close the speaker covering when an audio signal is not detected, such as a counter-clockwise electric motor direction. The enable signal is provided for a predetermined duration to allow power to be supplied to the motor control section 815 so the desired electric motor motion can occur. Electric motor motion can also be initiated by manually operating the manual rotate switch 835. The enable signal may have a variable voltage level to variably control the power switch section 805 to provide variable control of the electric motor 380. Having a predetermined duration of the enable signal to the power switch section 805 reduces unwanted motion of the speaker covering by restricting power to the electric actuator when no motion is desired.

The motor control section includes a logic inverter device 855, two position limit sensors 390*a* and 390*b*, such as the touch switches, a conventional H bridge bi-directional motor control circuit comprising four transistors 860*a*, 860*b*, 860*c* and 860*d*, such as pairs of p-channel and n-channel power MOSFET devices, and ancillary circuitry.

The logic inverter 855 receives and inverts the direction signal, where the direction signal and the inverted direction signal are used for selectively activating the four transistors 860*a*, 860*b*, 860*c*, and 860*d* to power the electric motor 380 in selected directions.

The position limit sensors 390*a* and 390*b* provide power to two of the four transistors 860*a*, 860D, 860*c*, or 860*d*. The position limit sensors 390*a* and 390*b* are normally active, e.g., a normally closed touch switch, unless the speaker covering is moved to a position limit in which case the position limit sensor 390*a* or 390*b* located at that position limit becomes inactive, e.g., an opened touch switch, to indicate that the position limit has been reached. The speaker covering cannot be moved further in the direction of the inactive position limit sensor by not providing power to the transistor to which it is connected, while the other, active position limit sensor allows speaker covering motion toward its direction by providing power to the transistor to which it is connected.

During electric motor motion in a first direction, such as the clockwise electric motor direction, a first transistor 860*a*, for example, is activated by the direction signal providing power to a first side of the electric motor armature, so long as the position limit sensor 390*a*, for example, to which it is connected is active and a fourth transistor 860*d*, for example, is activated by the inverted direction signal providing ground to a second side of the electric motor armature. During electric motor motion in a second direction, such as the counter-clockwise electric motor direction, a second transistor 860*b*, for example, is activated by the inverted direction signal providing power to the second side of the electric motor armature, so long as the position limit sensor 390*b*, for example, to which it is connected is active and a third transistor 860*c*, for example, is activated by the direction signal providing ground to the first side of the electric motor armature.

While the present invention has been particularly shown and described with reference to exemplary embodiments thereof, it will be understood by those of ordinary skill in the art that various changes in form and details may be made therein without departing from the spirit and scope of the present invention as defined by the following claims,

What is claimed is:

1. A speaker cabinet, comprising:

at least one speaker contained in the speaker cabinet; and a speaker covering shrouding the at least one speaker, wherein the speaker covering includes an open portion and a closed portion, wherein the speaker covering rotates 360 degrees around the speaker cabinet to expose the at least one speaker through the open portion in a first position and to conceal the at least one speaker behind the closed portion in a second position, and wherein the speaker covering surrounds the speaker cabinet to form the entire external surface of the speaker cabinet except for a bottom external surface of the speaker cabinet.

2. The speaker cabinet of claim 1, wherein the speaker covering motion is automatic and provided by an electromechanical motion control system including at least one electric actuator and at least one electric actuator drive circuit.

3. The speaker cabinet of claim 2, wherein the at least one electric actuator includes an electric motor or an electric solenoid.

4. The speaker cabinet of claim 2, wherein the at least one electric actuator provides motion to the speaker covering with at least one of gears, belts, linkages, or magnetic induction.

5. The speaker cabinet of claim 2, wherein the automatic speaker covering motion is activated by the electromechanical motion control system in response to an audio signal received by the at least one speaker.

6. The speaker cabinet of claim 2, wherein the speaker cabinet and the speaker covering are substantially cylindrical.

7. The speaker cabinet of claim 6, wherein the speaker covering can slide up or down to expose the at least one speaker.

8. The speaker cabinet of claim 6, wherein the speaker covering can slide up or down to expose the at least one speaker through the open portion.

9. The speaker cabinet of claim 6, wherein the speaker covering has a left portion that can slide toward a left side of the speaker cabinet to expose a left side of the at least one speaker and a right portion that can slide toward a right side of the speaker cabinet to expose a right side of the at least one speaker.

10. The speaker cabinet of claim 2, wherein the speaker cabinet has a substantially rectangular cross section and the speaker covering is substantially rectangular or substantially flat.

11. The speaker cabinet of claim 10, wherein the speaker covering can slide up or down to expose the at least one speaker.

12. The speaker cabinet of claim 10, wherein the speaker covering can slide up or down to expose the at least one speaker through the open portion.

13. The speaker cabinet of claim 10, wherein the speaker covering can slide or swing to one side of the speaker cabinet to expose the at least one speaker.

14. The speaker cabinet of claim 10, wherein the speaker covering can swing to one side of the speaker cabinet to expose the at least one speaker and can slide along the one side of the speaker cabinet after it swings toward the one side of the speaker cabinet.

15. The speaker cabinet of claim 10, wherein the speaker covering has a left portion that can slide or swing toward a left side of the speaker cabinet to expose a left side of the at least one speaker, and a right portion that can slide or swing toward a right side of the speaker cabinet to expose a right side of the at least one speaker.

16. The speaker cabinet of claim 10, wherein the speaker covering has a left portion that can swing toward a left side of the speaker cabinet to expose a left side of the at least one speaker and can slide along the left side of the speaker cabinet after it swings toward the left side of the speaker cabinet, and a right portion that can swing toward a right side of the speaker cabinet to expose a right side of the at least one speaker and can slide along the right side of the speaker cabinet after it swings toward the right side of the speaker cabinet.

17. A speaker cabinet, comprising:

at least one speaker contained in the speaker cabinet;

a speaker cover covering the at least one speaker and having an open portion and a closed portion; and a speaker cabinet base having a first portion and a second portion, wherein the speaker cover is rotated 360 degrees around the at least one speaker by the second portion of the speaker cabinet base to expose the at least one speaker through the open portion in a first position and to conceal the at least one speaker behind the closed portion in a second position, and wherein the speaker cover surrounds the speaker cabinet to form the entire external surface of the speaker cabinet except for a bottom external surface of the speaker cabinet.

18. The speaker cabinet of claim 17, wherein the speaker cabinet rotary motion is automatic and provided by an electromechanical motion control system including at least one electric actuator and at least one electric actuator drive circuit.

19. The speaker cabinet of claim 18, wherein the at least one electric actuator includes an electric motor or an electric solenoid.

20. The speaker cabinet of claim 18, wherein the at least one electric actuator provides the rotary motion between the speaker cabinet and the stationary speaker cabinet base with at least one of gears, belts, linkages, or magnetic induction.

21. The speaker cabinet of claim 18, wherein the automatic rotary motion is activated by the electromechanical motion control system in response to an audio signal received by the at least one speaker.

22. The speaker cabinet of claim 17, wherein the at least one speaker is kept stationary by the first portion of the speaker cabinet base when the speaker cover is rotated around the at least one speaker by the second portion of the speaker cabinet base.

* * * * *